US009483986B2

(12) United States Patent
Wang

(10) Patent No.: US 9,483,986 B2
(45) Date of Patent: Nov. 1, 2016

(54) METHOD AND A DEVICE FOR COMPENSATING RESPONSE TIME OF LIQUID CRYSTAL DISPLAY

(75) Inventor: Yanfeng Wang, Beijing (CN)

(73) Assignee: BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 1457 days.

(21) Appl. No.: 12/421,956

(22) Filed: Apr. 10, 2009

(65) Prior Publication Data

US 2009/0256791 A1 Oct. 15, 2009

(30) Foreign Application Priority Data

Apr. 11, 2008 (CN) ..... 2008 1 0103876

(51) Int. Cl.
*G09G 3/36* (2006.01)

(52) U.S. Cl.
CPC ..... *G09G 3/3611* (2013.01); *G09G 2320/0252* (2013.01); *G09G 2320/041* (2013.01); *G09G 2340/16* (2013.01)

(58) Field of Classification Search
CPC ..... G09G 3/3611; G09G 2340/16; G09G 2320/041; G09G 2320/0252
USPC ..... 345/89, 690
See application file for complete search history.

(56) References Cited

U.S. PATENT DOCUMENTS

2004/0246224 A1* 12/2004 Tsai et al. ..... 345/100
2005/0116902 A1* 6/2005 Miyzawa ..... 345/76
2006/0158415 A1* 7/2006 Izumi ..... 345/98
2007/0183218 A1* 8/2007 Lee et al. ..... 365/185.26

FOREIGN PATENT DOCUMENTS

| | | | |
|---|---|---|---|
| CN | 1517768 | A | 8/2004 |
| CN | 1909052 | A | 2/2007 |
| CN | 1949356 | A | 4/2007 |
| JP | 2004-317623 | A | 11/2004 |
| JP | 2006-065294 | A | 3/2006 |
| JP | 2006-195231 | A | 7/2006 |
| JP | 2007-219392 | A | 8/2007 |

(Continued)

*Primary Examiner* — Dennis Joseph
(74) *Attorney, Agent, or Firm* — Ladas & Parry LLP

(57) ABSTRACT

The present invention relates to a method for compensating response time of liquid crystal display and a device therefor. The compensating method comprises: receiving gray scale data of a picture in present frame and obtaining a first additional driving value according to the comparison result between gray scale data of the picture in present frame and gray scale data of the picture in previous frame; collecting the temperature value of liquid crystal layer and obtaining a temperature driving value according to said temperature value; and generating a second driving value that is applied to pixels according to the first additional driving value and the temperature driving value. The compensating device comprises: a first additional driving value module for obtaining a first additional driving value; a temperature driving value module for collecting the temperature value of liquid crystal layer and obtaining a temperature driving value according to said temperature value; and a second additional driving value module for generating a second additional driving value. The present invention can effectively reduce the response time of liquid crystal display and mitigate the streaking problem.

4 Claims, 10 Drawing Sheets

(56) References Cited

FOREIGN PATENT DOCUMENTS

| | | | |
|---|---|---|---|
| JP | 2007-233120 | A | 9/2007 |
| JP | 2007-323046 | A | 12/2007 |
| KR | 2007-77346 | A | 7/2007 |

* cited by examiner

METHOD AND A DEVICE FOR COMPENSATING RESPONSE TIME OF LIQUID CRYSTAL DISPLAY

FIELD OF THE INVENTION

The present invention relates to a method and a device for improving response time of liquid crystal display (LCD), a method and a device for compensating response time of liquid crystal display.

BACKGROUND OF THE INVENTION

The thin film transistor (TFT) LCD and TFT liquid crystal TV are increasing in size, and user's requirements for display performance are increasing. One important index for evaluating LCD performance is response time, which is the response time for each pixel to the input signal, that is, the time that each of liquid crystal molecules takes to perform luminance transition. As compared with the CRT display manner, the response time of each pixel under liquid crystal displaying to perform luminance transition is relatively longer. Correspondingly, when the image in LCD changes, the previous image can not disappear immediately, resulting in streaking phenomenon, thus influencing the display effect. In general, the shorter the response time is, the less apparent the streaking phenomenon is.

In order to meet the market demand, each of the big manufacturers try all their best to improve the response time of liquid crystal displaying with respect to streaking phenomenon. The research shows that the liquid crystal is temperature-dependent and often has a crystal point and a clear point. When the temperature is low, the liquid crystal is in crystal state. When the temperature increases, the liquid crystal molecules sway more frequently. When the temperature increases excessively, the liquid crystal will rotate and become liquid and this temperature is referred to clear point. When temperature is between the clear point and the crystal temperature, the liquid crystal is at a mediate state, namely, the work range of the liquid crystal. The response time of liquid crystal displaying is the sum of the gate ON time ton and the gate OFF time toff. The gate ON time and the gate OFF time are associated with viscidity coefficient $\eta$ of liquid crystal, the thickness of the liquid crystal box, the driving voltage applied to the liquid crystal layer and the dielectric constant anisotropy value. In order to reduce the response time of liquid crystal displaying, four methods is mainly adopted in the present technology, that is, reducing the viscidity coefficient $\eta$ of the liquid crystal material, increasing dielectric constant anisotropy value of the liquid crystal material, reducing the thickness of the liquid crystal box and increasing the driving voltage on the liquid crystal layer. Wherein, reducing the viscidity coefficient $\eta$ can reduce the gate ON time ton and the gate OFF time toff, thus achieving the object of reducing the response time. In addition, the viscidity coefficient $\eta$ is closely related to the temperature of the liquid crystal, thus the response time of the liquid crystal displaying is closely related to the temperature. FIG. 15 is a schematic diagram of the relation between the response time of liquid crystal displaying and the viscidity coefficient $\eta$ in prior art. As shown in FIG. 15, the higher the temperature of the liquid crystal is, the smaller the viscidity coefficient $\eta$ is and the shorter the response time is.

SUMMARY OF THE INVENTION

However, the present technology does not considered the influence of the liquid crystal layer temperature on response time, thus reducing the response time of liquid crystal displaying according to the method of the present technology is somewhat limited and the liquid crystal display still has the problem of streaking.

Embodiments of the present invention provide a method and a device for compensating response time of LCD, in which by temperature compensation, the response time of liquid crystal displaying can be effectively reduced and the streaking phenomenon can be improved.

An embodiment of the present invention provides a method for compensating the response time of LCD, comprising:

receiving gray scale data of a picture in present frame and obtaining a first additional driving value according to the comparison result between gray scale data of the picture in present frame and gray scale data of the picture in previous frame;

collecting the temperature value of liquid crystal layer and obtaining a temperature driving value according to said temperature value; and generating a second additional driving value that is applied to pixels according to the first additional driving value and the temperature driving value.

Wherein, receiving gray scale data of the picture in present frame and obtaining the first additional driving value according to the comparison result between gray scale data of the picture in present frame and gray scale data of the picture in previous frame comprises:

receiving and buffering gray scale data of the picture in present frame;

reading gray scale data of the picture in previous frame from a frame memory; and searching a first additional driving value look-up table for the first additional driving value corresponding to gray scale data of the picture in present frame and gray scale data of the picture in previous frame.

Wherein, collecting the temperature value of liquid crystal layer and obtaining the temperature driving value according to said temperature value comprises:

collecting and processing the temperature value of liquid crystal layer;

selecting a corresponding temperature look-up table according to said temperature value; and searching the temperature look-up table for a temperature driving value corresponding to said temperature value.

Wherein, generating the second driving value that is applied to pixels according to the first additional driving value and the temperature driving value comprises:

receiving the first additional driving value and the temperature driving value;

searching a second additional driving value look-up table for a second additional driving value corresponding to the first additional driving value and the temperature driving value; and outputting the second additional driving value that is applied to pixels.

Based on the above technical solution, the first additional driving value is a first pre-driving value, and the second additional driving value is a second pre-driving value that is applied to pixels in advance so as to pre-deflect the liquid crystal layer; or the first additional driving value is a first over-driving value, and the second additional driving value is a second over-driving value that is applied to pixels in overshooting manner so as to over-deflect the liquid crystal layer; or the first additional driving value comprises the first pre-driving value and the first over-driving value, and the second additional driving value comprises the second pre-driving value that is applied to pixels in advance so as to pre-deflect the liquid crystal layer and the second over-driving value that is applied to pixels in overshooting manner so as to over-deflect the liquid crystal layer.

An embodiment of the present invention also provides a device for compensating the response time of LCD, comprises:

a first additional driving value module for receiving gray scale data of a picture in present frame and obtaining a first additional driving value according to the comparison result between gray scale data of a picture in present frame and gray scale data of a picture in previous frame;

a temperature driving value module for collecting the temperature value of liquid crystal layer and obtaining a temperature driving value according to said temperature value; and a second additional driving value module connected to the first additional driving value module and the temperature driving value module respectively, for generating a second additional driving value that is applied to pixels according to the first additional driving value and the temperature driving value.

Wherein, the first additional driving value module comprises:

a first frame memory for receiving and buffering gray scale data of the picture in present frame;

a second frame memory for buffering gray scale data of the picture in previous frame; and a first additional driving value unit connected to the first frame memory and the second frame memory respectively, for reading gray scale data of the picture in present frame from the first frame memory, reading gray scale data of the picture in previous frame from the second frame memory and searching the first additional driving value look-up table for the first additional driving value corresponding to gray scale data of the picture in present frame and gray scale data of the picture in previous frame.

Wherein, the temperature driving value module comprises:

a temperature collecting and processing unit for collecting and processing the temperature value of liquid crystal layer;

a temperature look-up table unit for storing a plurality of temperature look-up tables; and a temperature driving value unit connected to the temperature collecting and processing unit and the temperature look-up table unit respectively, for selecting a corresponding temperature look-up table according to said temperature value and searching the temperature look-up table for a temperature driving value corresponding to said temperature value.

Wherein, the second additional driving value module comprises:

an additional driving reception unit connected to the first additional driving value module and the temperature driving value module respectively, for receiving the first additional driving value from the first additional driving value module and receiving the temperature driving value from the temperature driving value module;

an additional driving processing unit connected to the additional driving reception unit, for searching a second additional driving value look-up table for a second additional driving value corresponding to the first additional driving value and the temperature driving value; and an additional driving transmission unit connected to the additional driving processing unit, for outputting the second additional driving value that is applied to pixels.

Based on the above technical solution, the first additional driving value is a first pre-driving value, the first additional driving value module is a first pre-driving value module for obtaining the first pre-driving value, the second additional driving value is a second pre-driving value, the second additional driving value module is a second pre-driving value module for generating the second pre-driving value that is applied to pixels in advance so as to pre-deflect the liquid crystal layer; or the first additional driving value is a first over-driving value, the first additional driving value module is a first over-driving value module for obtaining the first over-driving value, the second additional driving value is a second over-driving value, the second additional driving value module is a second over-driving value module for generating the second over-driving value that is applied to pixels in overshooting manner so as to over-deflect the liquid crystal layer; or the first additional driving value comprises a first pre-driving value and a first over-driving value, the first additional driving value module is a first driving value module for obtaining the first pre-driving value and the first over-driving value, the second additional driving value comprises a second pre-driving value and a second over-driving value, the second additional driving value module is a second driving value module for generating the second pre-driving value that is applied to pixels in advance so as to pre-deflect the liquid crystal layer and generating the second over-driving value that is applied to pixels in overshooting manner so as to over-deflect the liquid crystal layer;

For the low response speed of LCD and problem of the serious streaking that exists in the present technology, the present invention provides a method for compensating response time of LCD and a device therefor in which the liquid crystal layer is pre-driven and over-driven according to the gray scale data of the picture in two adjacent frames, and effective compensation is performed by the temperature of the liquid crystal layer for pre-driving and over-driving, thus the deflection speed of the liquid crystal molecules is increased, the response time of liquid crystal displaying is effectively reduced, the streaking phenomenon is greatly mitigated and the better quality of display effect is provided.

The present invention will be further described in details below in connection with the drawings and the embodiments.

DESCRIPTION OF REFERENCE NUMBER

11—first pre-driving value module;
12—temperature driving value module;
13—second pre-driving value module;
14—first over-driving value module;
15—second over-driving value module;
16—first driving value module;
17—second driving value module;
111—first frame memory;
112—second frame memory;
113—first pre-driving value unit;
121—temperature collecting and processing unit;
122—temperature look-up table unit;
123—temperature driving value unit;
131—pre-driving reception unit;
132—pre-driving processing unit;
133—pre-driving transmission unit;
143—first over-driving value unit;
151—over-driving reception unit;
152—over-driving processing unit;
153—over-driving transmission unit;
1211—temperature sensor;
1212—filtering and amplifying circuit; and
1213—A/D converter.

DESCRIPTION OF THE PREFERRED EMBODIMENTS

Inventor's deep research shows that since LCD is influenced by the temperatures of surrounding environment, backlight, the driving chip and the like in the case of actual display, liquid crystal molecule's temperature is varying all the time, and these temperature variation cause liquid crystal molecule's viscidity coefficient to change, thereby affecting the response time of liquid crystal displaying. Especially, when the liquid crystal's temperature is relatively high or low, the response time of liquid crystal displaying is greatly changed, thus having a relatively high influence on the display effect of LCD.

A First Embodiment of the Method for Compensating the Response Time of LCD

In this embodiment, in the technical solution of the method for compensating the response time of LCD, the first additional driving value is a first pre-driving value, and the second additional driving value is a second pre-driving value that is applied to pixels in advance so as to pre-deflect the liquid crystal layer. Correspondingly, the first additional driving value look-up table is a first pre-driving value look-up table, and the second additional driving value look-up table is a second pre-driving value look-up table.

Figure 1:
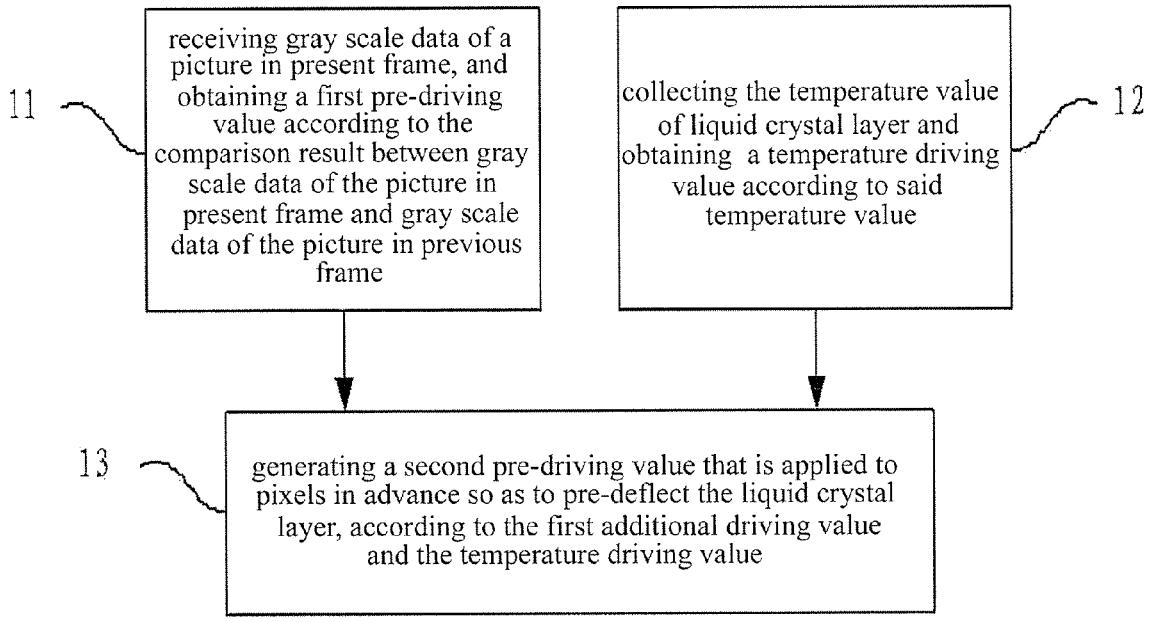
FIG. 1 is a flowchart of a first embodiment of the method for compensating the response time of LCD according to the present invention.

FIG. 1 is a flowchart of a first embodiment of the method for compensating the response time of LCD according to the present invention, comprising:

step 11 of receiving gray scale data of a picture in present frame and obtaining a first pre-driving value according to the comparison result between gray scale data of the picture in present frame and gray scale data of the picture in previous frame;

step 12 of collecting the temperature value of liquid crystal layer and obtaining a temperature driving value according to said temperature value;

step 13 of generating a second pre-driving value that is applied to pixels in advance so as to pre-deflect the liquid crystal layer, according to the first pre-driving value and the temperature driving value.

The present embodiment provides a method for compensating the response time of LCD, in which on the basis of comparing the gray scale data of pictures in two frames so as to obtain the first pre-driving value, collecting the temperature of liquid crystal layer and making compensation for the first pre-driving value according to the temperature driving value, thus making the pre-driving value that is applied to pixels in advance so as to pre-deflect the liquid crystal layer more suitable, the response time of LCD to display is effectively reduced and the streaking problem is mitigated. It should be noted that there is no rigid timing relation between the step 11 and the step 12.

Figure 2:
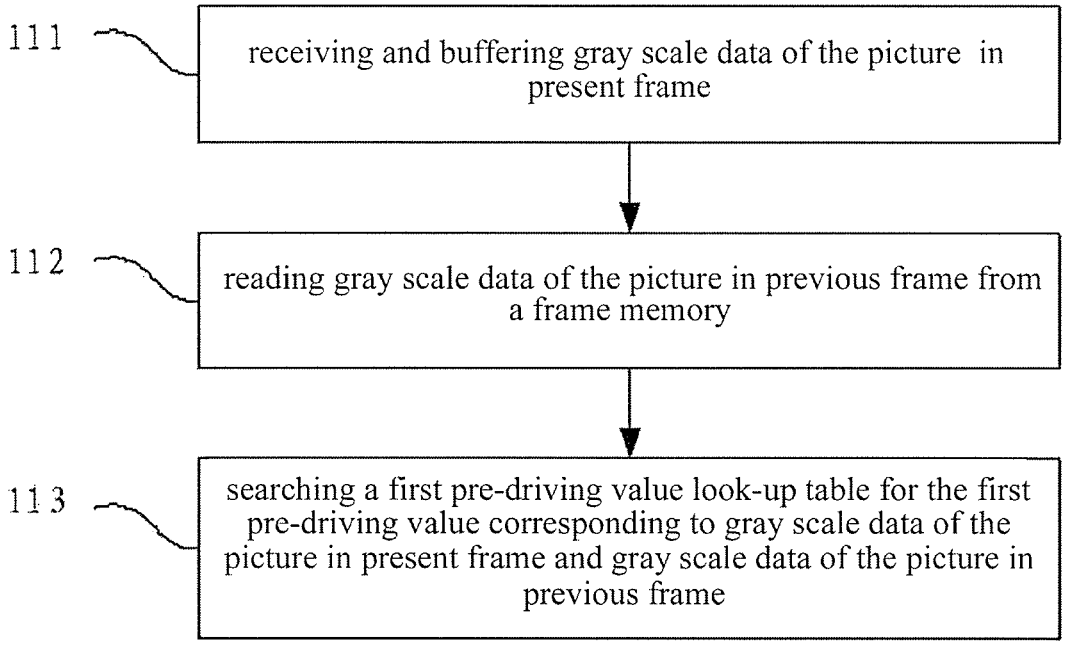
FIG. 2 is a flowchart of obtaining a first pre-driving value in the first embodiment of the method for compensating the response time of LCD according to the present invention.

FIG. 2 is a flowchart of obtaining a first pre-driving value in the first embodiment of the method for compensating the response time of LCD according to the present invention. In the technical solution, step 11 in the technical solution of FIG. 1 comprises:

step 111 of receiving and buffering gray scale data of the picture in present frame;

step 112 of reading gray scale data of the picture in previous frame from a frame memory; and step 113 of searching a first pre-driving value look-up table for the first pre-driving value corresponding to gray scale data of the picture in present frame and gray scale data of the picture in previous frame.

In this embodiment, the first pre-driving value look-up table is searched for the first pre-driving value by comparing the gray scale data of the pictures in previous and present frames. Table 1 is the first pre-driving value look-up table. As shown in table 1, the rows of the first pre-driving value look-up table represent the gray scale data of the picture in present frame, and the columns thereof represent the gray scale data of the picture in previous frame. The first pre-driving value look-up table records the first pre-driving value that is required when the gray scale data of the picture in previous frame transits to the gray scale data of the picture in present frame. The first pre-driving values $a_{(0,0)}$, $a_{(0,1)}$, . . . , $a_{(255,254)}$, $a_{(255,255)}$ is respectively associated with a corresponding gray scale data of the previous frame and gray scale data of the present frame, and can be obtained by calculation or experiment. For example, for a certain pixel, if the gray scale data of the picture in present frame is L1 and the gray scale data of the picture in previous flame is L254, then the first pre-driving value $a_{(1,254)}$ in this case can be obtained by searching the first pre-driving value look-up table for the cross point of the row L1, column 254.

TABLE 1

First pre-driving value look-up table

| | grey data of previous frame | | | | |
|---|---|---|---|---|---|
| grey data of present frame | L0 | L1 | . . . | L254 | L255 |
| L0 | $a_{(0,0)}$ | $a_{(0,1)}$ | . . . | $a_{(0,254)}$ | $a_{(0,255)}$ |
| L1 | $a_{(1,0)}$ | $a_{(1,1)}$ | . . . | $a_{(1,254)}$ | $a_{(1,255)}$ |
| . . . | . . . | . . . | . . . | . . . | . . . |
| L254 | $a_{(254,0)}$ | $a_{(254,1)}$ | . . . | $a_{(254,254)}$ | $a_{(254,255)}$ |
| L255 | $a_{(255,0)}$ | $a_{(255,1)}$ | . . . | $a_{(255,254)}$ | $a_{(255,255)}$ |

Figure 3:
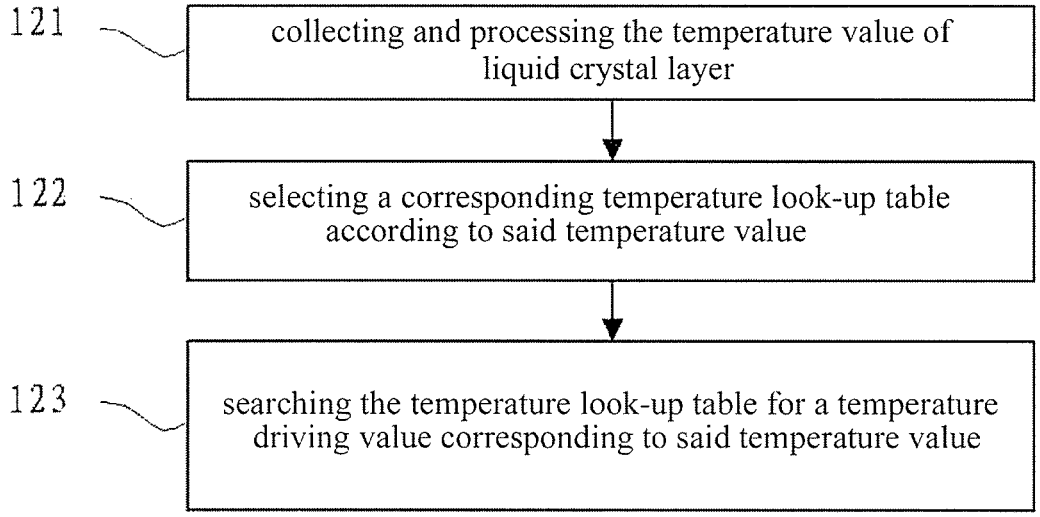
FIG. 3 is a flowchart of obtaining temperature driving value in the first embodiment of the method for compensating the response time of LCD according to the present invention.

FIG. 3 is a flowchart of obtaining temperature driving value in the first embodiment of the method for compensating the response time of LCD according to the present invention. In the technical solution shown in the FIG. 1, the step 12 comprises:

step 121 of collecting and processing the temperature value of liquid crystal layer;

step 122 of selecting a corresponding temperature look-up table according to said temperature value; and step 123 of searching the temperature look-up table for a temperature driving value corresponding to said temperature value.

In this embodiment, to obtain the temperature driving value, firstly, collecting and processing the temperature value of liquid crystal layer, then selecting a corresponding temperature look-up table according to said temperature value, and finally searching the temperature look-up table for a temperature driving value corresponding to said temperature value. In the present embodiment, four temperature look-up tables that respectively correspond to a different sub range of temperature value of liquid crystal layer are created, temperature driving values corresponding to different temperature values of the liquid crystal layer in each sub range of the temperature value of liquid crystal layer are set respectively. Since the viscidity coefficient η between −20° C.~60° C. is relatively large, four sub ranges, that is, ~20° C.~0° C., 0° C.~20° C., 20° C.~40° C. and 40° C.~60° C. are set respectively. The quantization codes corresponding to these four sub ranges are 00, 01, 10, 11 respectively, and these four quantization codes respectively correspond to four temperature look-up tables, namely, look-up table 0, look-up table 1, look-up table 2 and look-up table 3. A corresponding temperature look-up table is selected according to the temperature value of liquid crystal layer. Table 2 is a temperature look-up table. As shown in table 2, the first row of the temperature look-up table represents temperature value of the liquid crystal layer, and the second row thereof represents the temperature driving value. The temperature look-up table records the temperature driving value that is required by different temperature values of liquid crystal layer. Temperature driving value b20, . . . , b40 is respectively associated with a corresponding temperature value of liquid crystal layer and can be obtained by calculation or experiment. For example, the temperature value of liquid crystal layer is 39° C. which is in the sub range of 20° C.~40° C., and the quantization code corresponding to this sub range is 10 which corresponds to look-up table 2, thus temperature look-up table 2 is selected. Searching for the value $b_{39}$ corresponding to 39° C. in the first row of temperature look-up table 2, that is, the temperature driving value required in this case is obtained. It should be noted that four temperature look-up tables is only one of implement ways, and practically, it is possible to set a corresponding number of temperature look-up table according to the requirements.

TABLE 2

Temperature look-up table

| | | | | | |
|---|---|---|---|---|---|
| temperature value of liquid crystal layer | 20° C. | 21° C. | . . . | 39° C. | 40° C. |
| temperature driving value | $b_{20}$ | $b_{21}$ | . . . | $b_{39}$ | $b_{40}$ |

Figure 4:
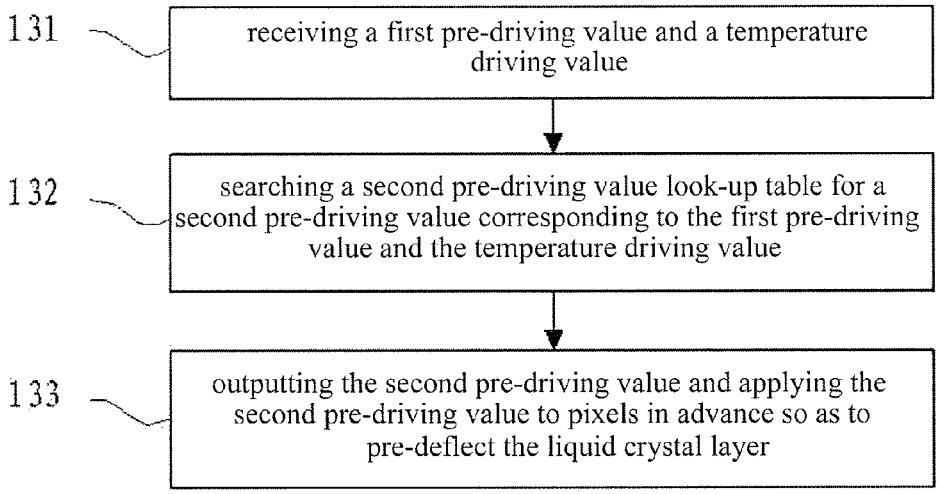
FIG. 4 is a flowchart of obtaining a second pre-driving value in the first embodiment of the method for compensating the response time of LCD according to the present invention.

FIG. 4 is a flowchart of obtaining a second pre-driving value in the first embodiment of the method for compensating the response time of LCD according to the present invention. In the technical solution shown in the FIG. 1, step 13 comprises:

step 131 of receiving a first pre-driving value and a temperature driving value;

step 132 of searching a second pre-driving value look-up table for a second pre-driving value corresponding to the first pre-driving value and the temperature driving value; and step 133 of outputting the second pre-driving value that is applied to pixels in advance so as to pre-deflect the liquid crystal layer.

In the present embodiment, a second pre-driving value look-up table is created, in which the second pre-driving value look-up table is searched for second pre-driving value corresponding to the first pre-driving value and the temperature driving value according to the received first pre-driving value and temperature driving value. Table 3 is the second pre-driving value look-up table. As shown in table 3, the rows of this table represent the first pre-driving value A1, A2 . . . , and the columns thereof represent the temperature driving value B1, B2 . . . . This table records the second pre-driving values required in the case of different first pre-driving values and different temperature driving values. For example, if the first pre-driving value is A2 and the temperature driving value is B3, then the second pre-driving value look-up table is searched, and the cross point of the row B3, column A2 can be found, that is, second pre-driving value $c_{(3,2)}$ required in this case. The second pre-driving value $c_{(3,2)}$ is applied to pixels in advance so as to pre-deflect the liquid crystal layer. The data in the second pre-driving value look-up table can be obtained by calculation on the first pre-driving value and the temperature driving value. For example, the equation for calculating the second pre-driving value can be as follow:

$$c_{(3,2)}=k1\times A2+k2\times B3$$

Wherein, $c_{(3,2)}$ is the second pre-driving value, A2 is the first pre-driving value, B3 is the temperature driving value, and k1, k2 are the coefficients of the first pre-driving value and the temperature driving value respectively and can be obtained by experiments.

TABLE 3

| Second pre-driving value look-up table | | | | | |
|---|---|---|---|---|---|
| | the first pre-driving value | | | | |
| temperature driving value | A1 | A2 | A3 | A4 | . . . |
| B1 | $c_{(1,1)}$ | $c_{(1,2)}$ | $c_{(1,3)}$ | $c_{(1,4)}$ | . . . |
| B2 | $C_{(2,1)}$ | $c_{(2,2)}$ | $c_{(2,3)}$ | $c_{(2,4)}$ | . . . |
| B3 | $c_{(3,1)}$ | $c_{(3,2)}$ | $c_{(3,3)}$ | $c_{(3,4)}$ | . . . |
| B4 | $c_{(4,1)}$ | $c_{(4,2)}$ | $c_{(4,3)}$ | $c_{(4,4)}$ | . . . |
| . . . | . . . | . . . | . . . | . . . | . . . |

In this embodiment, the first pre-driving value look-up table is searched according to gray scale data of the picture in present frame and gray scale data of the picture in previous frame that have been received, so as to obtain the first pre-driving value; the temperature values of liquid crystal layer are collected and processed, a corresponding temperature look-up table is selected according to said temperature value, and the temperature look-up table is searched for the temperature driving value corresponding to said temperature value; the second pre-driving value look-up table is searched for the second pre-driving value corresponding to the first pre-driving value and the temperature driving value, according to the first pre-driving value and the temperature driving value; applying the second pre-driving value to pixels in advance so as to pre-deflect the liquid crystal layer. The present embodiment has fully considered the influence on response time by the liquid crystal layer's temperature during liquid crystal displaying. Effective compensation is performed on pre-driving value according to the temperature driving value, in which large pre-driving value is applied when temperature is low and small pre-driving value is applied when temperature is high, so that the pre-deflection of the liquid crystal layer is more effective, response time of LCD is reduced and streaking problem is mitigated.

The First Embodiment of the Device for Compensating the Response Time of LCD

In this embodiment, in the technical solution of the device for compensating the response time of LCD according to the present invention, the first additional driving value is a first pre-driving value, the second additional driving value is a second pre-driving value that is applied to pixels in advance so as to pre-deflect the liquid crystal layer, the first additional driving value module is a first pre-driving value module for obtaining the first pre-driving value, and the second additional driving value is a second pre-driving value module for generating the second pre-driving value that is applied to pixels in advance so as to pre-deflect the liquid crystal layer. Correspondingly, the first additional driving value look-up table is a first pre-driving value look-up table, the first additional driving value unit is a first pre-driving value unit for searching for the first pre-driving value, the additional driving reception unit is a pre-driving reception unit, the second additional driving value look-up table is a second pre-driving value look-up table, the additional driving processing unit is a pre-driving processing unit for searching for the second pre-driving value, and the additional driving transmission unit is a pre-driving transmission unit for outputting the second pre-driving value.

Figure 5:
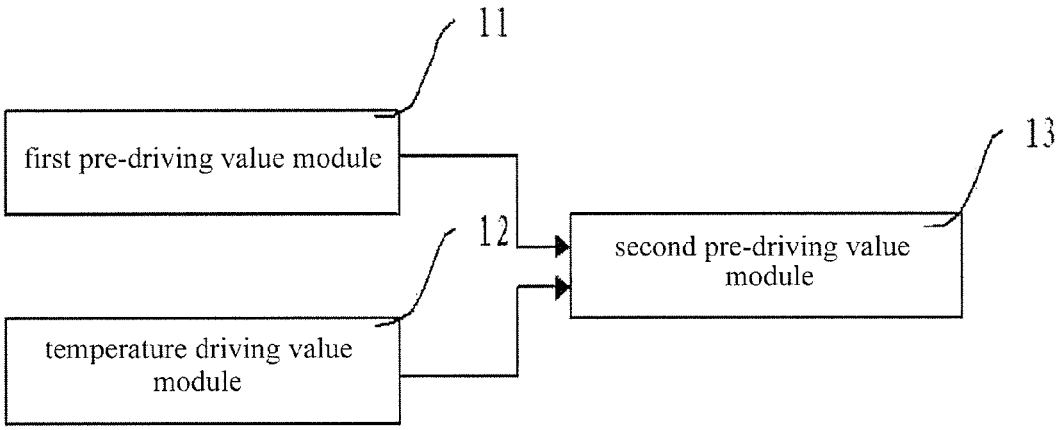
FIG. 5 is a structural diagram of the first embodiment of the device for compensating the response time of LCD according to the present invention.

FIG. 5 is a structural diagram of the first embodiment of the device for compensating the response time of LCD according to the present invention. As shown in FIG. 5, in this embodiment, the device for compensating the response time of LCD comprises a first pre-driving value module 11 for receiving gray scale data of a picture in present frame and obtaining a first pre-driving value according to the comparison result between gray scale data of the picture in present frame and gray scale data of the picture in previous frame; a temperature driving value module 12 for collecting the temperature value of liquid crystal layer and obtaining a temperature driving value according to said temperature value; and a second pre-driving value module 13 connected to the first pre-driving value module 11 and the temperature driving value module 12 respectively, for generating a second pre-driving value that is applied to pixels in advance so as to pre-deflect the liquid crystal layer, according to the first pre-driving value and the temperature driving value.

Figure 6:
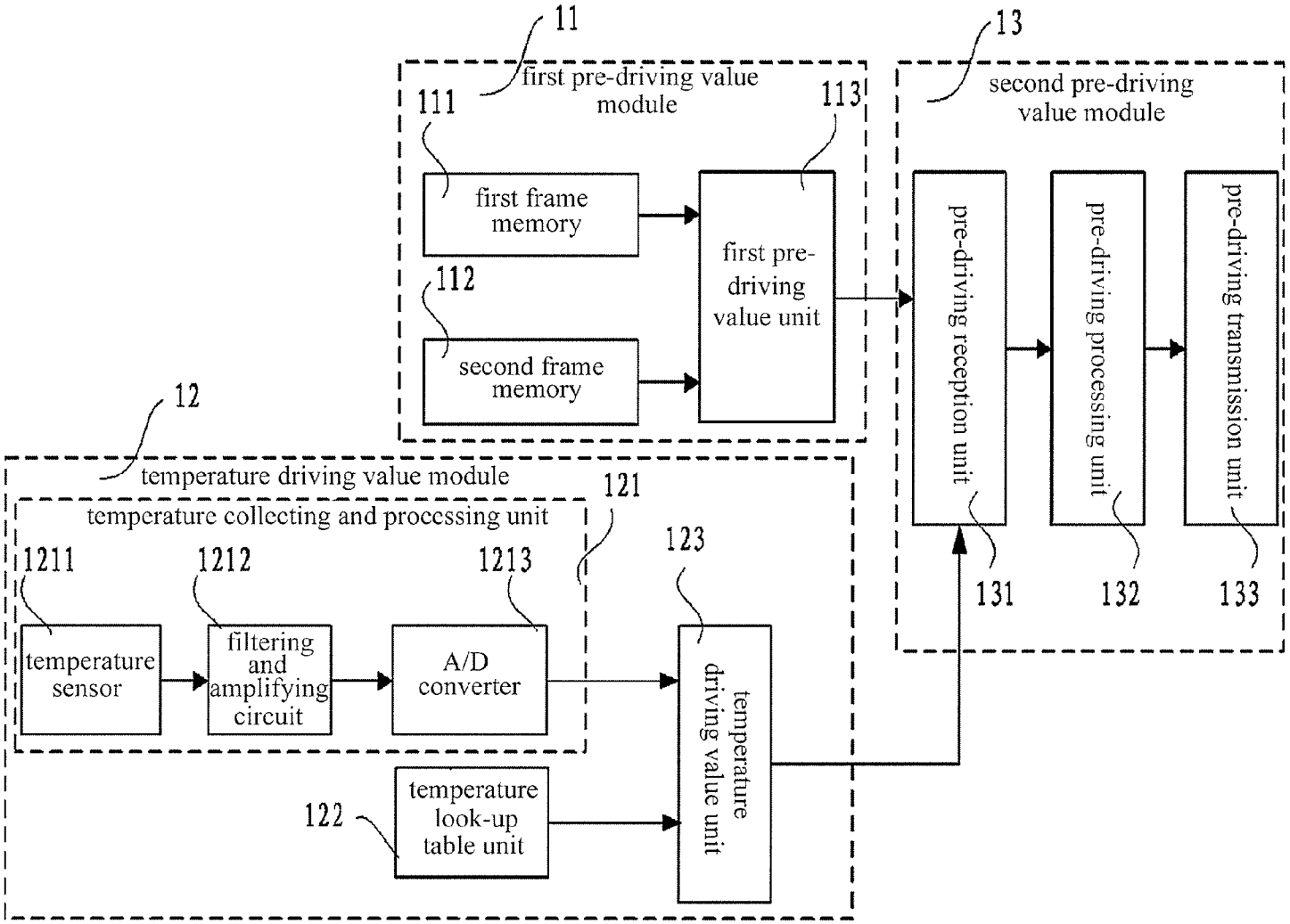
FIG. 6 is a structural diagram of the detailed implementation of the first embodiment of the device for compensating the response time of LCD according to the present invention.

FIG. 6 is a structural diagram of the detailed implementation of the first embodiment of the device for compensating the response time of LCD according to the present invention. As shown in FIG. 6, the detailed implemental structure comprises a first pre-driving value module 11, a temperature driving value module 12 and a second pre-driving value module 13. wherein the first pre-driving value module 11 comprises a first frame memory 111 for receiving and buffering gray scale data of the picture in present frame; a second frame memory 112 for buffering gray scale data of the picture in previous frame; and a first pre-driving value unit 113 connected to the first frame memory 111 and the second frame memory 112 respectively, for reading gray scale data of the picture in present frame from the first frame memory 111, reading gray scale data of the picture in previous frame from the second frame memory 112 and searching the first pre-driving value look-up table for the first pre-driving value corresponding to gray scale data of the picture in the present frame and gray scale data of the picture in the previous frame. The temperature driving value module 12 comprises a temperature collecting and processing unit 121 for collecting and processing the temperature value of liquid crystal layer; a temperature look-up table unit 122 for storing a plurality of temperature look-up tables; and a temperature driving value unit 123 connected to the temperature collecting and processing unit 121 and the temperature look-up table unit 122 respectively, for selecting a corresponding temperature look-up table according to said temperature value and searching the temperature look-up table for a temperature driving value corresponding to said temperature value. Wherein, the temperature collecting and processing unit 121 comprises a temperature sensor 1211 arranged in the liquid display panel, for collecting the temperature of liquid crystal layer and outputting voltage value; a filtering and amplifying circuit 1212 connected to the temperature sensor 1211, for performing filtering and amplifying processes on said voltage value; and an A/D converter 1213 connected to the filtering and amplifying circuit 1212, for performing A/D conversion on the voltage value that has been filtered and amplified and transmitting it to the temperature driving value unit 123. The second pre-driving value module 13 comprises an pre-driving reception unit 131 connected to the first pre-driving value unit 113 and the temperature driving value unit 123 respectively, for receiving the first pre-driving value from the first pre-driving value module 11 and receiving the temperature driving value from the temperature driving value module 12; a pre-driving processing unit 132 connected to the pre-driving reception unit 131, for searching a second pre-driving look-up table for a second pre-driving value corresponding to the first pre-driving value and the temperature driving value; and a pre-driving transmission unit 133 connected to the pre-driving processing unit 132, for outputting the second pre-driving value that is applied to pixels in advance so as to pre-deflect the liquid crystal layer.

The Second Embodiment of the Device for Compensating the Response Time of LCD In this embodiment, in the technical solution of the device for compensating the response time of LCD according to the present invention, the first additional driving value is a first over-driving value, and the second additional driving value is a second over-driving value that is applied to pixels in overshooting manner so as to over-deflect the liquid crystal layer. Correspondingly, the first additional driving value look-up table is a first over-driving value look-up table, and the second additional driving value look-up table is a second over-driving value look-up table.

Figure 7:
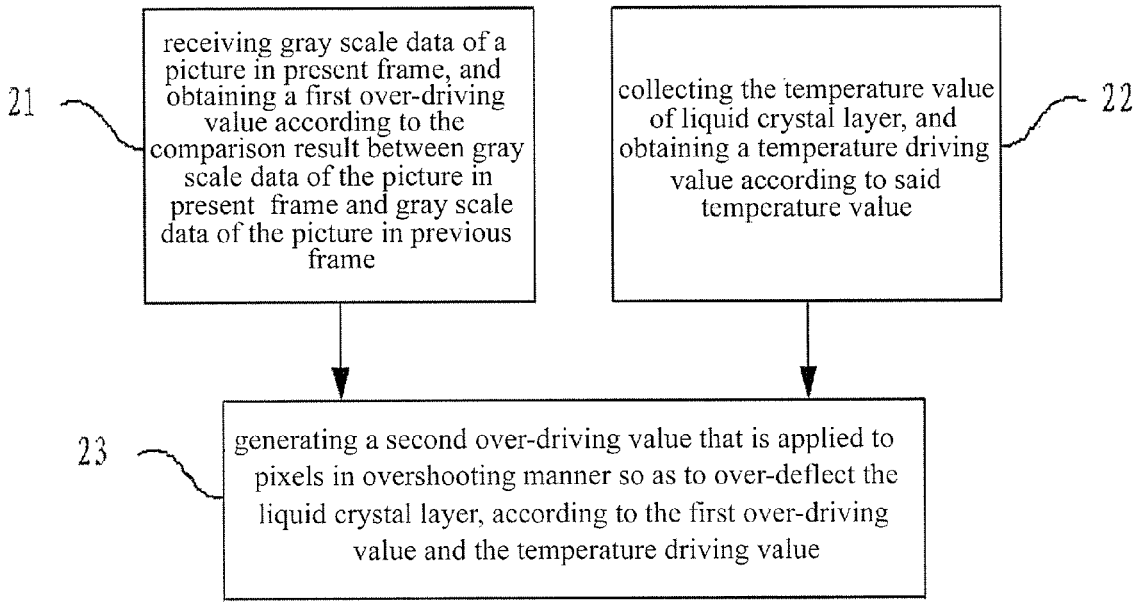
FIG. 7 is a flowchart of a second embodiment of the method for compensating the response time of LCD according to the present invention.

FIG. 7 is a flowchart of a second embodiment of the method for compensating the response time of LCD according to the present invention, comprising:

step 21 of receiving gray scale data of a picture in present frame and obtaining a first over-driving value according to the comparison result between gray scale data of the picture in present frame and gray scale data of the picture in previous frame;

step 22 of collecting the temperature value of liquid crystal layer and obtaining a temperature driving value according to said temperature value;

step 23 of generating a second over-driving value that is applied to pixels in overshooting manner so as to over-deflect the liquid crystal layer, according to the first over-driving value and the temperature driving value.

The present embodiment provides a method for compensating the response time of LCD, in which on the basis of comparing the gray scale data of pictures in two frames so as to obtain the first over-driving value, collecting the temperature of liquid crystal layer and making compensation for the first over-driving value according to the temperature driving value, thus the over-driving value that is applied to pixels in overshooting manner so as to over-deflect the liquid crystal layer is more reasonable, the response time of LCD to display is effectively reduced and the streaking problem is mitigated. It should be noted that there is no rigid timing relation between the step 21 and the step 22.

Figure 8:
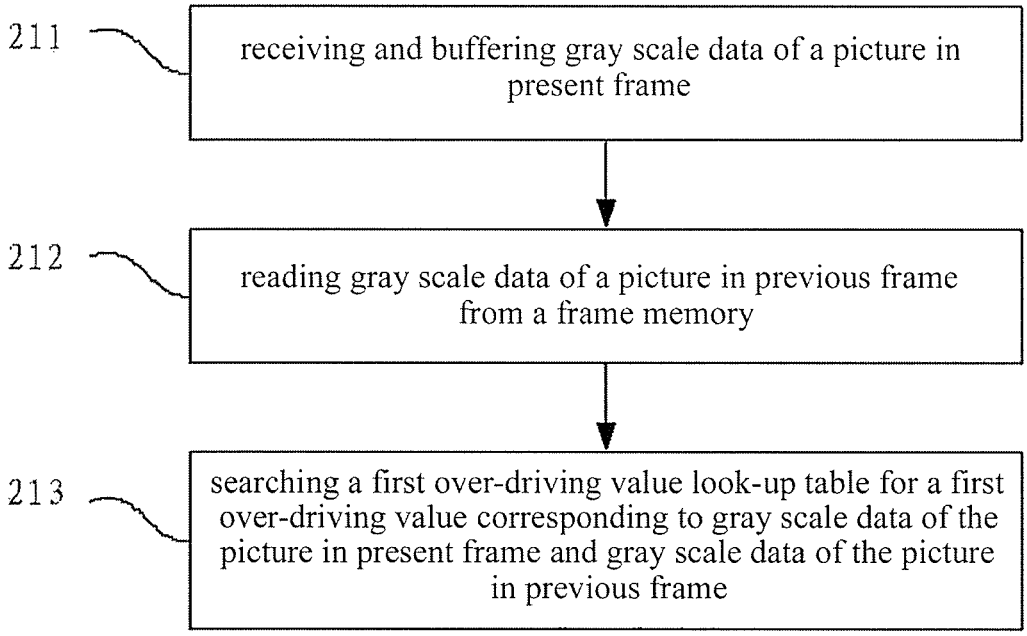
FIG. 8 is a flowchart of obtaining a first pre-driving value in the second embodiment of the method for compensating the response time of LCD according to the present invention.

FIG. 8 is a flowchart of obtaining a first over-driving value in the second embodiment of the method for compensating the response time of LCD according to the present invention. In the technical solution shown in FIG. 7, step 21 comprises:

step 211 of receiving and buffering gray scale data of a picture in present frame;

step 212 of reading gray scale data of a picture in previous frame from a frame memory; and step 213 of searching a first over-driving value look-up table for a first over-driving value corresponding to gray scale data of the picture in present frame and gray scale data of the picture in previous frame.

The step 21 of this embodiment comprises: searching the first over-driving value look-up table for the first over-driving value by comparing the gray scale data of the pictures in previous and present frames. Table 4 is a first over-driving value look-up table. As shown in table 4, the rows of the first over-driving value look-up table represent the gray scale data of a picture in present frame, and the columns thereof represent the gray scale data of a picture in previous frame. The first over-driving value look-up table records the first over-driving value that is required when the gray scale data of the picture in previous frame transits to the gray scale data of the picture in present frame. The over-driving value $d_{(0,0)}$, $d_{(0,1)}$, . . . , $d_{(255,254)}$, $d_{(255,255)}$ is respectively associated with corresponding gray scale data of the previous frame and gray scale data of the present frame, and can be obtained by calculation or experiment. For example, for a certain pixel, if the gray scale data of a picture in present frame is L1 and the gray scale data of a picture in previous frame is L254, then the first over-driving value $d_{(1,254)}$ in this case can be obtained by searching the first over-driving value look-up table for the cross point of the row L1, column 254.

TABLE 4

First over-driving value look-up table

| grey data | grey data of previous frame | | | | |
|---|---|---|---|---|---|
| of present frame | L0 | L1 | . . . | L254 | L255 |
| L0 | $d_{(0,0)}$ | $d_{(0,1)}$ | . . . | $d_{(0,254)}$ | $d_{(0,255)}$ |
| L1 | $d_{(1,0)}$ | $d_{(1,1)}$ | . . . | $d_{(1,254)}$ | $d_{(1,255)}$ |
| . . . | . . . | . . . | . . . | . . . | . . . |
| L254 | $d_{(254,0)}$ | $d_{(254,1)}$ | . . . | $d_{(254,254)}$ | $d_{(254,255)}$ |
| L255 | $d_{(255,0)}$ | $d_{(255,1)}$ | . . . | $d_{(255,254)}$ | $d_{(255,255)}$ |

In the technical solution as shown in FIG. 7, the step 22 comprises:

step 221 of collecting and processing the temperature value of liquid crystal layer;

step 222 of selecting a corresponding temperature look-up table according to said temperature value; and step 223 of searching the temperature look-up table for a temperature driving value corresponding to said temperature value.

The step 22 in this embodiment is same as that of the solution in FIG. 3 described above.

Figure 9:
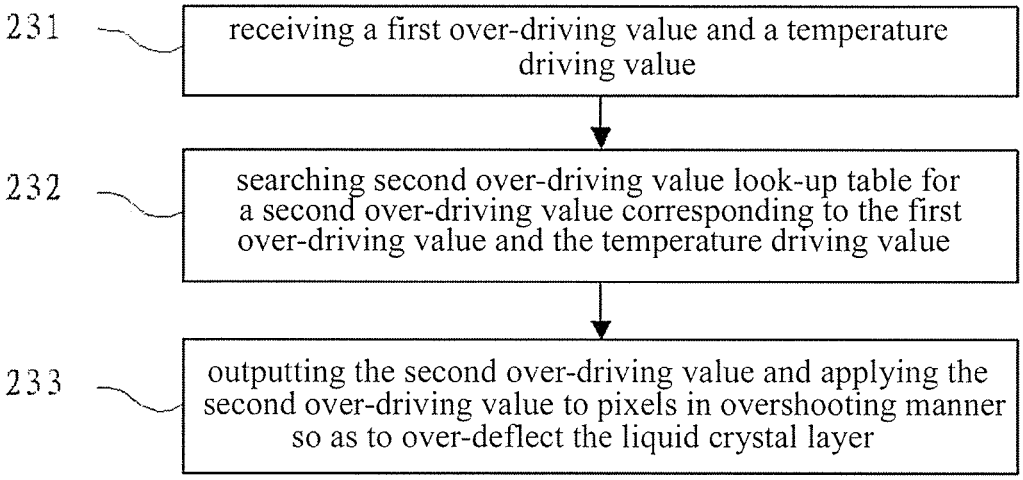
FIG. 9 is a flowchart of obtaining a second pre-driving value in the second embodiment of the method for compensating the response time of LCD according to the present invention.

FIG. 9 is a flowchart of obtaining a second over-driving value in the second embodiment of the method for compensating the response time of LCD according to the present invention. In the technical solution shown in the FIG. 7, step 23 comprises:

step 231 of receiving a first over-driving value and a temperature driving value;

step 232 of searching second over-driving value look-up table for a second over-driving value corresponding to the first over-driving value and the temperature driving value; and step 233 of outputting the second over-driving value that is applied to pixels in overshooting manner so as to over-deflect the liquid crystal layer.

With a second over-driving value look-up table created in the present embodiment, the second over-driving value look-up table is searched for second over-driving value corresponding to the first over-driving value and the temperature driving value according to the first over-driving value and temperature driving value that have been received. Table 5 is the second over-driving value look-up table. As shown in table 5, the rows of this table represent the first over-driving value, and the columns thereof represent the temperature driving value. This table records the second over-driving values required in the case of different first over-driving values and different temperature driving values. For example, if the first over-driving value is D2 and the temperature driving value is B3, then the second over-driving value $e_{(3,2)}$ required in this case is obtained by searching the second over-driving look-up table for the cross point of row B3, column D2. The second over-driving value $e_{(3,2)}$ is applied to pixels in overshooting manner so as to over-deflect the liquid crystal layer. The data in the second over-driving value look-up table can be obtained by calculation on the first over-driving value and the temperature driving value. For example, the equation for calculating the second over-driving value can be as follow:

$$e_{(3,2)}=k3\times D2+k4\times B3$$

wherein, $e_{(3,2)}$ is the second over-driving value, D2 is the first over-driving value, B3 is the temperature driving value, and k3, k4 are the coefficients of the first over-driving value and the temperature driving value respectively and can be obtained by experiments.

TABLE 5

Second over-driving value look-up table

| | first over-driving value | | | | |
|---|---|---|---|---|---|
| temperature driving value | D1 | D2 | D3 | D4 | . . . |
| B1 | $e_{(1,1)}$ | $e_{(1,2)}$ | $e_{(1,3)}$ | $e_{(1,4)}$ | . . . |
| B2 | $e_{(2,1)}$ | $e_{(2,2)}$ | $e_{(2,3)}$ | $e_{(2,4)}$ | . . . |
| B3 | $e_{(3,1)}$ | $e_{(3,2)}$ | $e_{(3,3)}$ | $e_{(3,4)}$ | . . . |
| B4 | $e_{(4,1)}$ | $e_{(4,2)}$ | $e_{(4,3)}$ | $e_{(4,4)}$ | . . . |
| . . . | . . . | . . . | . . . | . . . | . . . |

In this embodiment, the first over-driving value look-up table is searched according to gray scale data of the picture in present frame and gray scale data of the picture in previous frame that have been received, so as to obtain the first over-driving value; the temperature values of liquid crystal layer are collected and processed, a corresponding temperature look-up table is selected according to said temperature value, and the temperature look-up table is searched for the temperature driving value corresponding to said temperature value; the second over-driving value look-up table is searched for the second over-driving value corresponding to the first over-driving value and the temperature driving value, according to the first over-driving value and the temperature driving value; applying the second over-driving value to pixels in overshooting manner so as to over-deflect the liquid crystal layer. The present embodiment has fully considered the influence on response time by the liquid crystal layer's temperature during liquid crystal displaying. Effective compensation is performed on over-driving value according to the temperature driving value, in which large over-driving value is applied when temperature is low and small over-driving value is applied when temperature is high, so that the over-deflection of the liquid crystal layer is more effective, response time of LCD is reduced and streaking problem is mitigated.

The Second Embodiment of the Device for Compensating the Response Time of LCD In this embodiment, in the technical solution of the device for compensating the response time of LCD according to the present invention, the first additional driving value is a first over-driving value, the second additional driving value is a second over-driving value that is applied to pixels in overshooting manner so as to over-deflect the liquid crystal layer, the first additional driving value module is a first over-driving value module for obtaining the first over-driving value, and the second additional driving value module is a second over-driving value module for generating the second over-driving value that is applied to pixels in overshooting manner so as to over-deflect the liquid crystal layer. Correspondingly, the first additional driving value look-up table is a first over-driving value look-up table, the first additional driving value unit is a first over-driving value unit for searching for the first over-driving value, the additional driving reception unit is an over-driving reception unit, the second additional driving value look-up table is a second over-driving value look-up table, the additional driving processing unit is an over-driving processing unit for searching for the second over-driving value, and the additional driving transmission unit is an over-driving transmission unit for outputting the second over-driving value.

Figure 10:
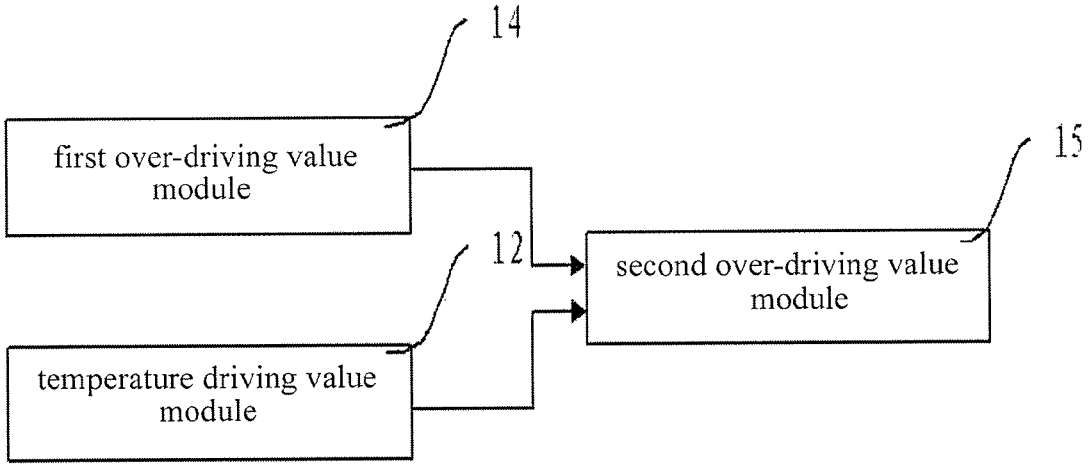
FIG. 10 is a structural diagram of the second embodiment of the device for compensating the response time of LCD according to the present invention.

FIG. 10 is a structural diagram of the second embodiment of the device for compensating the response time of LCD according to the present invention. As shown in FIG. 10, the device for compensating the response time of LCD in this embodiment comprises a first over-driving value module 14 for receiving gray scale data of a picture in present frame and obtaining a first over-driving value according to the comparison result between gray scale data of the picture in present frame and gray scale data of the picture in previous frame; a temperature driving value module 12 for collecting the temperature value of liquid crystal layer and obtaining a temperature driving value according to said temperature value; and a second over-driving value module 15 connected to the first over-driving value module 14 and the temperature driving value module 12 respectively, for generating a second over-driving value that is applied to pixels in overshooting manner so as to over-deflect the liquid crystal layer, according to the first over-driving value and the temperature driving value.

Figure 11:
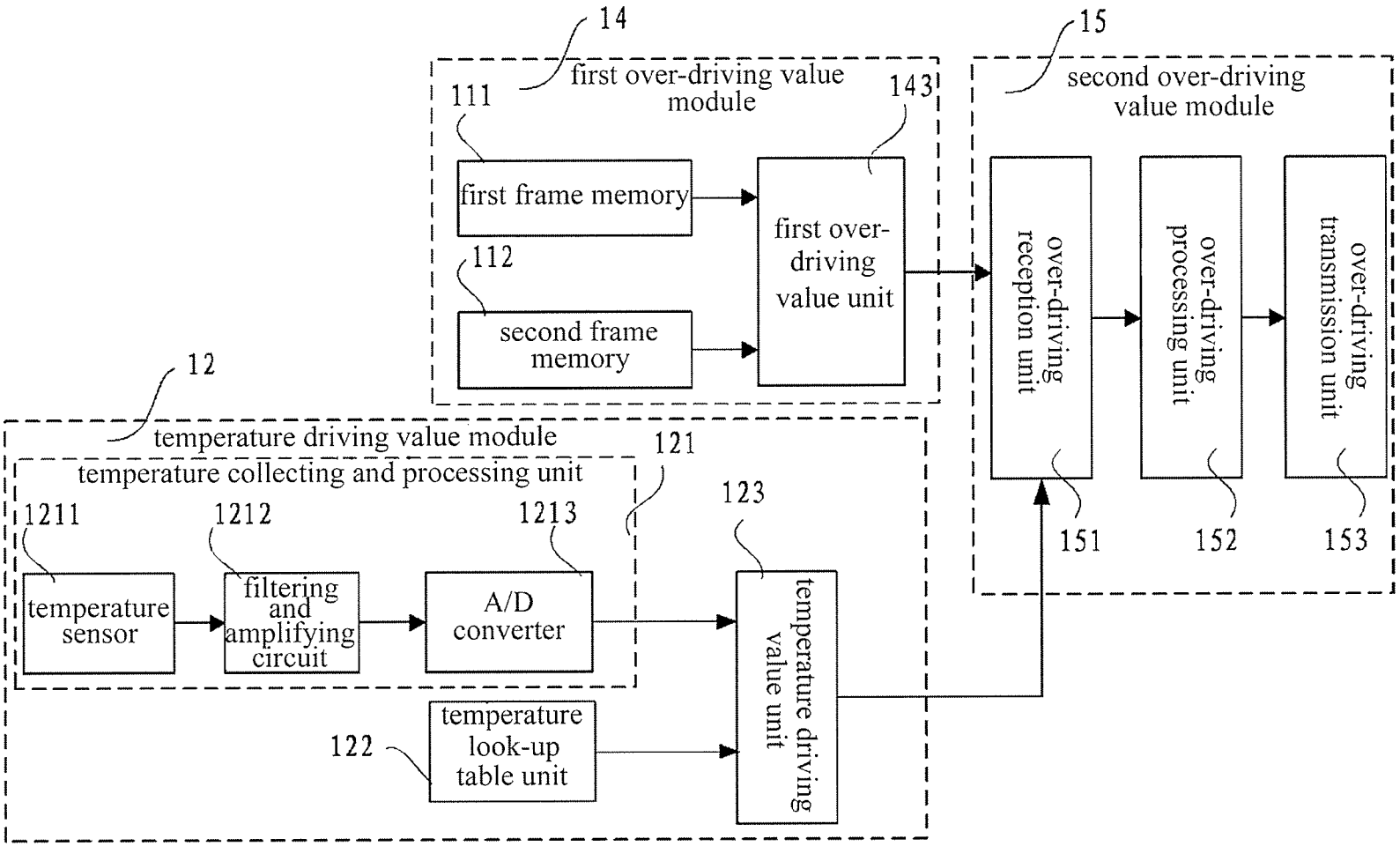
FIG. 11 is a structural diagram of the detailed implementation of the second embodiment of the device for compensating the response time of LCD according to the present invention.

FIG. 11 is a structural diagram of the detailed implementation of the second embodiment of the device for compensating the response time of LCD according to the present invention. As shown in FIG. 11, the detailed implemental structure comprises a first over-driving value module 14, a temperature driving value module 12 and a second over-driving value module 15. Wherein the first over-driving value module 14 comprises a first frame memory 111 for receiving and buffering gray scale data of a picture in present frame; a second frame memory 112 for buffering gray scale data of the picture in previous frame; and a first over-driving value unit 143 connected to the first frame memory 111 and the second frame memory 112 respectively, for reading gray scale data of the picture in present frame from the first frame memory 111, reading gray scale data of the picture in previous frame from the second frame memory 112 and searching first over-driving value look-up table for the first over-driving value corresponding to gray scale data of the picture in the present frame and gray scale data of the picture in the previous frame. The temperature driving value module in this embodiment is same as the the temperature driving value module in FIG. 6. The second over-driving value module 15 comprises an over-driving reception unit 151 connected to the first over-driving value unit 143 and the temperature driving value unit 123 respectively, for receiving the first over-driving value from the first over-driving value module 14 and receiving the temperature driving value from the temperature driving value module 12; an over-driving processing unit 152 connected to the over-driving reception unit 151, for searching a second over-driving look-up table for a second over-driving value corresponding to the first over-driving value and the temperature driving value; and an over-driving transmission unit 153 connected to the over-driving processing unit 132, for outputting the second over-driving value that is applied the second over-driving value to pixels in overshooting manner so as to over-deflect the liquid crystal layer.

The Third Embodiment of the Method for Compensating the Response Time of LCD

In this embodiment, in the technical solution of the method for compensating the response time of LCD according to the present invention, the first additional driving value is a first pre-driving value and a first over-driving value, and the second pre-driving value is a second pre-driving value that is applied to pixels in advance so as to pre-deflect the liquid crystal layer and a second over-driving value that is applied to pixels in overshooting manner so as to over-deflect the liquid crystal layer. Correspondingly, the first additional driving value look-up table comprises the first pre-driving value look-up table for searching for the first pre-driving value and the first over-driving value look-up table for searching for the first over-driving value, and the second additional driving value look-up table comprises the second pre-driving value look-up table for searching for the second pre-driving value and the second over-driving value look-up table that is used to search the second over-driving value.

Figure 12:
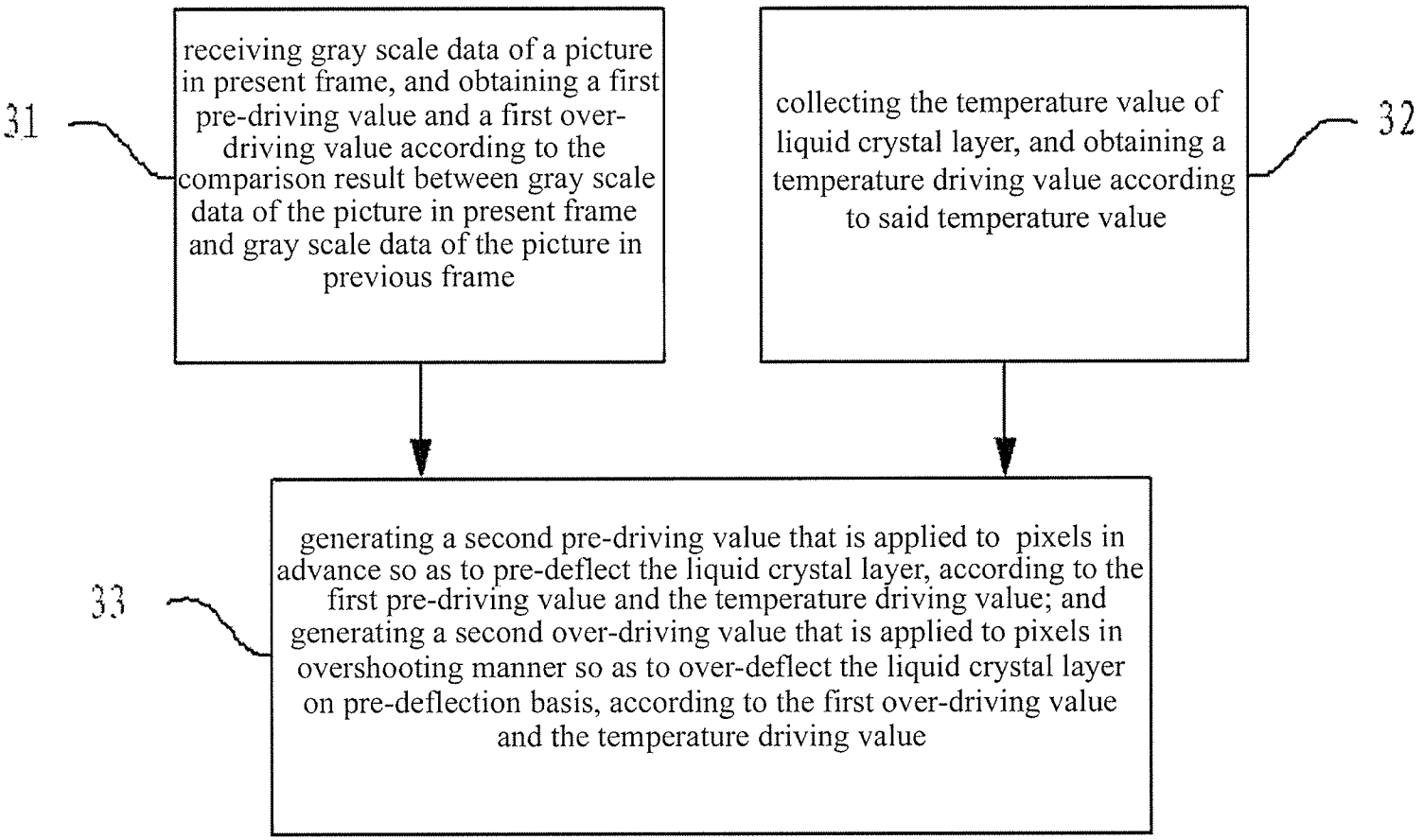
FIG. 12 is a flowchart of a third embodiment of the method for compensating the response time of LCD according to the present invention.

FIG. 12 is a flowchart of a third embodiment of the method for compensating the response time of LCD according to the present invention, comprising:

step 31 of receiving gray scale data of a picture in present frame and obtaining a first pre-driving value and a first over-driving value according to the comparison result between gray scale data of the picture in present frame and gray scale data of the picture in previous frame;

step 32 of collecting the temperature value of liquid crystal layer and obtaining a temperature driving value according to said temperature value;

step 33 of generating a second pre-driving value that is applied to pixels in advance so as to pre-deflect the liquid crystal layer, according to the first pre-driving value and the temperature driving value; and generating a second over-driving value that is applied to pixels in overshooting manner so as to over-deflect the liquid crystal layer on pre-deflection basis, according to the first over-driving value and the temperature driving value.

The present embodiment provides a method for compensating the response time of LCD, in which on the basis of comparing the gray scale data of pictures in present and previous frames so as to obtain the first pre-driving value and the first over-driving value, collecting the temperature of liquid crystal layer and compensating for the first pre-driving value and the first over-rotating value according to the temperature driving value, thus respectively obtaining the second pre-driving value that is applied to pixels in advance so as to pre-deflect the liquid crystal layer and the second over-driving value that is applied to pixels in overshooting manner so as to over-deflect the liquid crystal layer on the basis of pre-deflection, thereby the deflection speed is faster, the response time of LCD to display is effectively reduced and the streaking problem is mitigated. It should be noted that there is no rigid timing relation between the step 31 and the step 32.

In the technical solution shown in FIG. 12, step 31 comprises:

step 311 of receiving and buffering gray scale data of the picture in present frame;

step 312 of reading gray scale data of the picture in previous frame from a frame memory; and step 313 of searching a first pre-driving value look-up table for a first pre-driving value corresponding to gray scale data of the picture in present frame and gray scale data of the picture in previous frame, and searching a first over-driving value look-up table for a first over-driving value corresponding to gray scale data of the picture in present frame and gray scale data of the picture in previous frame.

In the technical solution shown in FIG. 12, step 33 comprises:

step 341 of receiving the first pre-driving value, the first over-driving value and the temperature driving value;

step 342 of searching a second pre-driving value look-up table for a second pre-driving value corresponding to the first pre-driving value and the temperature driving value, and searching second over-driving value look-up table for a second over-driving value corresponding to the first over-driving value and the temperature driving value; and step 343 of outputting the second pre-driving value that is applied to pixels in advance so as to pre-deflect the liquid crystal layer, and outputting the second over-driving value that is applied to pixels in overshooting manner so as to over-deflect the liquid crystal layer on the basis of pre-deflection.

In this embodiment, by comparing the gray scale data of pictures in previous and present frames, the first pre-driving value look-up table is searched for a first pre-driving value and the first over-driving value look-up table is searched for a first over-driving value. Wherein the flow of searching for the first pre-driving value is same as the flow shown in FIG. 2, the flow of searching for the first over-driving value is same as the flow shown in FIG. 8, the flow of searching for the second pre-driving value is same as the flow shown in FIG. 4, the flow of searching for the second over-driving value is same as the flow shown in FIG. 9, and the flow of obtaining the temperature driving value is same as the flow shown in FIG. 3, therefore those will be omitted here.

In this embodiment, a first pre-driving value look-up table and a first over-driving value look-up table are searched according to gray scale data of the picture in present frame and gray scale data of the picture in previous frame that have been received respectively, so as to obtain a first pre-driving value and a first over-driving value; the temperature value of liquid crystal layer is collected and processed, a corresponding temperature look-up table is selected according to said temperature value, and the temperature look-up table is searched for a temperature driving value corresponding to said temperature value; according to the first pre-driving value, the first over-driving value and the temperature driving value, the second pre-driving value look-up table is searched for a second pre-driving value corresponding to the first pre-driving value and the temperature driving value, and the second over-driving value look-up table is searched for a second over-driving value corresponding to the first over-driving value and the temperature driving value; applying the second pre-driving value to pixels in advance so as to pre-deflect the liquid crystal layer, and applying the second over-driving value to pixels in overshooting manner so as to over-deflect the liquid crystal layer. The present embodiment has fully considered the influence of the liquid crystal layer's temperature on response time when liquid crystal displays. First, the liquid crystal layer is pre-deflected according to the effective compensation of the temperature driving value with respect to the pre-driving value. Then, effective compensation is performed on the over-driving value according to the temperature driving value. Thus on the basis of effective pre-deflection, the liquid crystal layer is effectively over-deflected, the response time of LCD is reduced and the streaking problem is mitigated.

The Fourth Embodiment of the Device for Compensating the Response Time of LCD

In this embodiment, in the technical solution of the device for compensating the response time of LCD according to the present invention, the first additional driving value comprises a first pre-driving value and a first over-driving value; the second additional driving value comprises a second pre-driving value that is applied to pixels in advance so as to pre-deflect the liquid crystal layer, and a second over-driving value that is applied to pixels in overshooting manner so as to over-deflect the liquid crystal layer; the first additional driving value module is a first driving value module for obtaining the first pre-driving value and the first over-driving value; the second additional driving value module is a second driving value module for generating the second pre-driving value that is applied to pixels in advance so as to pre-deflect the liquid crystal layer and the second over-driving value that is applied to pixels in overshooting manner so as to over-deflect the liquid crystal layer. Correspondingly, the first additional driving value look-up table comprises a first pre-driving value look-up table for searching for the first pre-driving value, and a first over-driving value look-up table for searching for the first over-driving value; the first additional driving value unit comprises a first pre-driving value unit for searching for the first pre-driving value and a first over-driving value unit for searching for the first over-driving value; the second additional driving value look-up table comprises a second pre-driving value look-up table for searching for the second pre-driving value and a second over-driving value look-up table for searching for the second over-driving value; the additional driving reception unit comprises a pre-driving reception unit and an over-driving reception unit; the additional driving processing unit comprises a pre-driving processing unit for searching for the second pre-driving value, and an over-driving processing unit for searching for the second over-driving value; and the additional driving transmission unit comprises a pre-driving transmission unit for outputting the second pre-driving value, and an over-driving transmission unit for outputting the second over-driving value.

Figure 13:
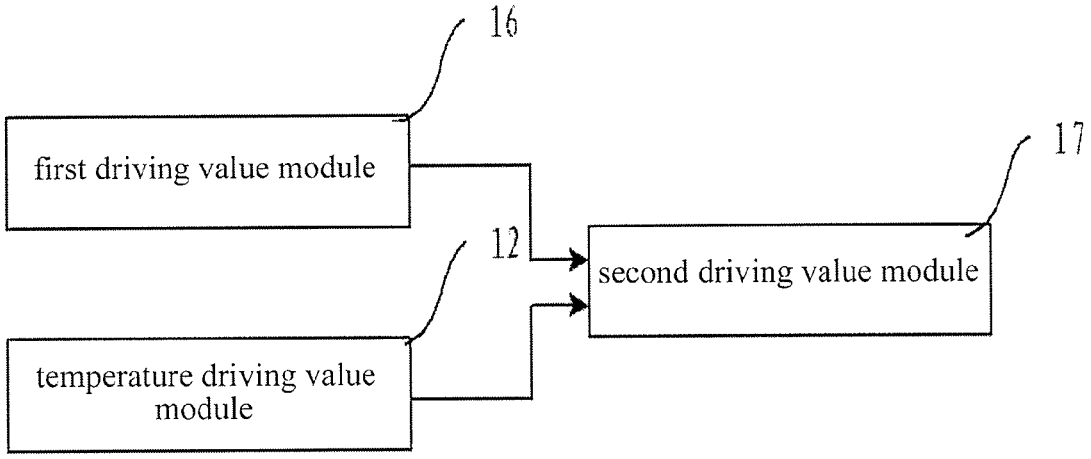
FIG. 13 is a structural diagram of the fourth embodiment of the device for compensating the response time of LCD according to the present invention.

FIG. 13 is a structural diagram of the fourth embodiment of the device for compensating the response time of LCD according to the present invention. As shown in FIG. 13, the device for compensating the response time of LCD in this embodiment comprises a first driving value module 16 for receiving gray scale data of a picture in present frame and obtaining a first pre-driving value and a first over-driving value according to the comparison result between gray scale data of the picture in present frame and gray scale data of the picture in previous frame; a temperature driving value module 12 for collecting the temperature value of liquid crystal layer and obtaining a temperature driving value according to said temperature value; and a second driving value module 17 connected to the first driving value module 16 and the temperature driving value module 12 respectively, for generating a second pre-driving value that is applied to pixels in advance so as to pre-deflect the liquid crystal layer, according to the first pre-driving value and the temperature driving value, and generating a second over-driving value that is applied to the pre-deflected pixels in overshooting manner so as to over-deflect the liquid crystal layer on the basis of the pre-deflection, according to the first over-driving value and the temperature driving value.

Figure 14:
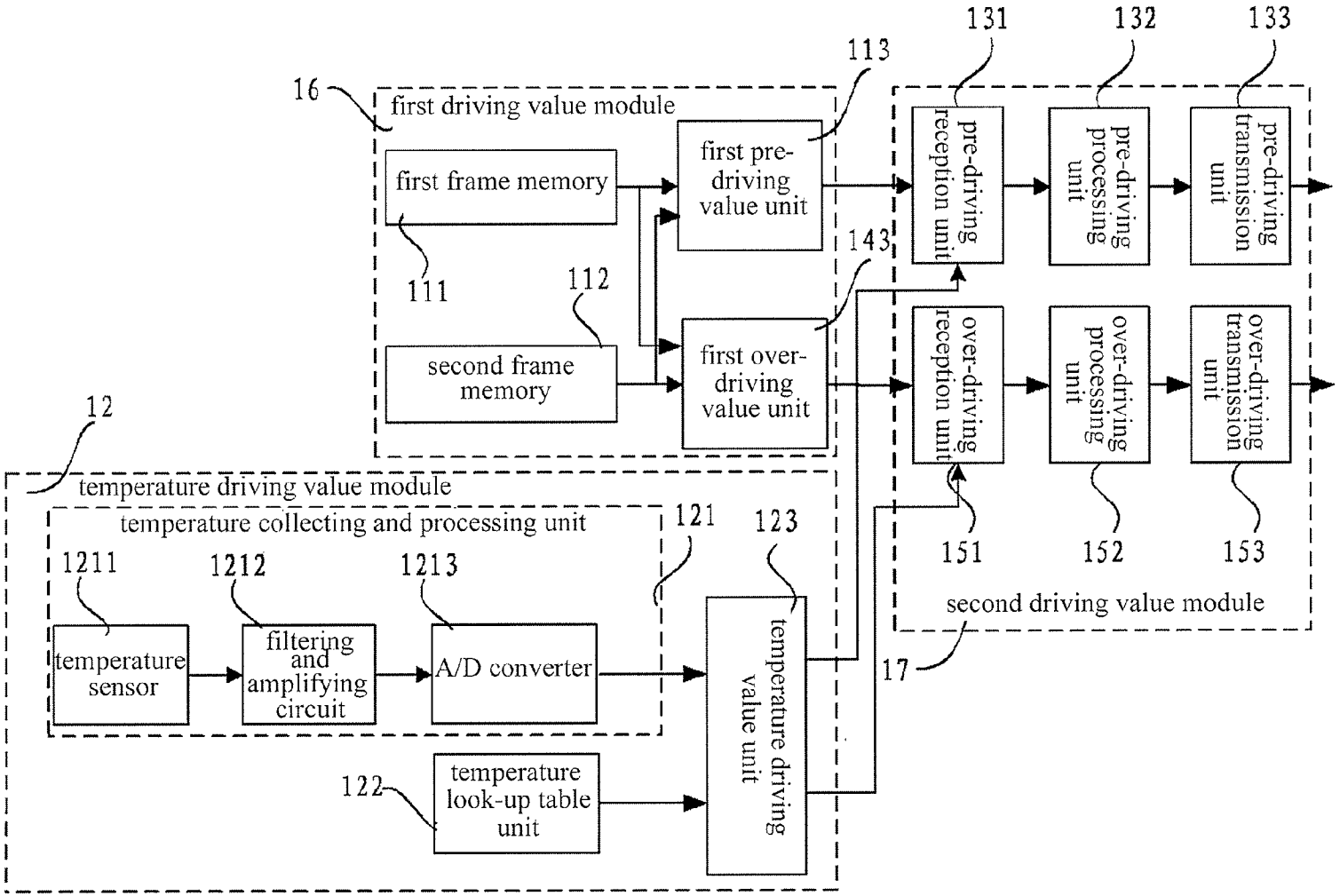
FIG. 14 is a structural diagram of the detailed implementation of the fourth embodiment of the device for compensating the response time of LCD according to the present invention.
Figure 15:
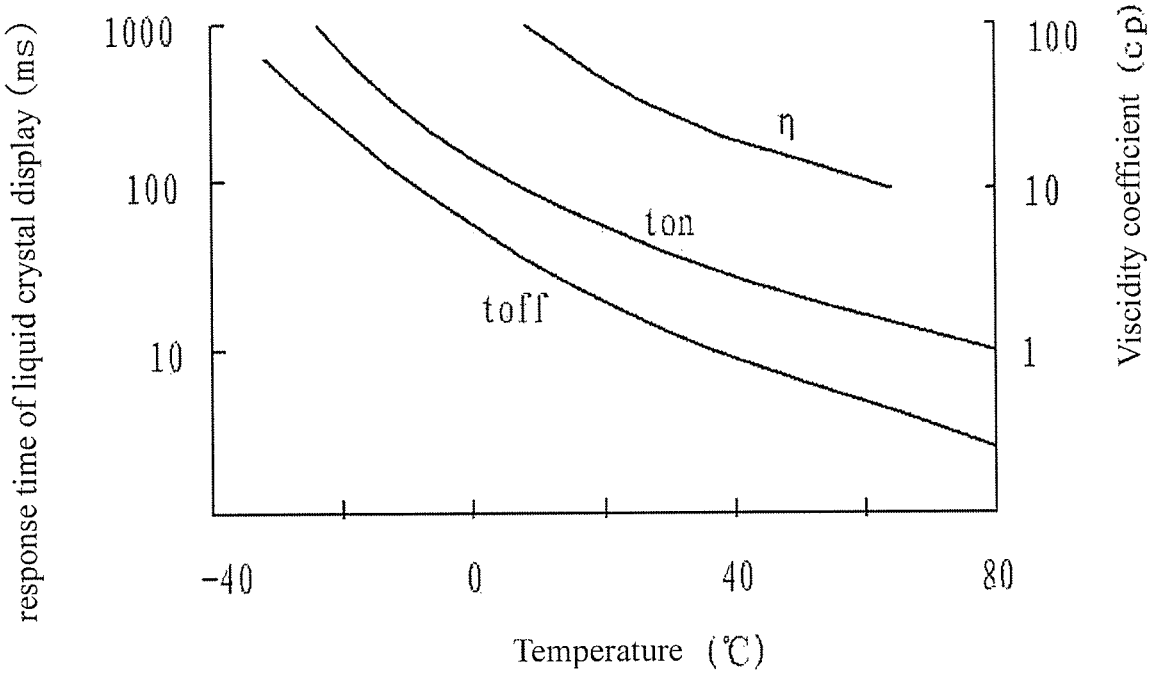
FIG. 15 is a schematic diagram of the relation between the response time of liquid crystaland viscidity coefficient $\eta$ in prior art.

FIG. 14 is a structural diagram of the detailed implementation of the fourth embodiment of the device for compensating the response time of LCD according to the present invention. As shown in FIG. 14, the detailed implemental structure comprises a first driving value module 16, a temperature driving value module 12 and a second driving value module 17. Wherein the first driving value module 16 comprises a first frame memory 111; a second frame memory 112; a first pre-driving value unit 113 connected to the first frame memory 111 and the second frame memory 112 respectively, for reading gray scale data of the picture in present frame from the first frame memory 111, reading gray scale data of the picture in previous frame from the second frame memory 112, and searching the first pre-driving value look-up table for a first pre-driving value corresponding to gray scale data of the picture in the present frame and gray scale data of the picture in the previous frame; and a first over-driving value unit 143 connected to the first frame memory 111 and the second frame memory 112 respectively, for reading gray scale data of the picture in present frame from the first frame memory 111, reading gray scale data of the picture in previous frame from the second frame memory 112, and searching the first over-driving value look-up table for a first over-driving value corresponding to gray scale data of the picture in the present frame and gray scale data of the picture in the previous frame. The temperature driving value module 12 is same as the temperature driving value module shown in FIG. 6. The second driving value module 17 comprises a pre-driving reception unit 131, a pre-driving processing unit 132, a pre-driving transmission unit 133, an over-driving reception unit 151, an over-driving processing unit 152 and an over-driving transmission unit 153. Wherein, the pre-driving reception unit 131 is connected to the first pre-driving value unit 113 and the temperature driving value unit 123 respectively, for receiving the first pre-driving value from the first pre-driving value unit 113 and receiving the temperature driving value from the temperature driving value unit 123; the pre-driving processing unit 132 is connected to the pre-driving reception unit 131, for searching a second pre-driving look-up table for a second pre-driving value according to the first pre-driving value and the temperature driving value; the pre-driving transmission unit 133 is connected to the pre-driving processing unit 132, for outputting the second pre-driving value that is applied to pixels in advance so as to pre-deflect the liquid crystal layer; the over-driving reception unit 151 is connected to the first over-driving value unit 143 and the temperature driving value unit 123 respectively, for receiving the first over-driving value from the first over-driving value unit 143 and receiving the temperature driving value from the temperature driving value unit 123; the over-driving processing unit 152 is connected to the over-driving reception unit 151, for searching the second over-driving look-up table for a second over-driving value according to the first over-driving value and the temperature driving value; and the over-driving transmission unit 153 is connected to the over-driving processing unit 152, for outputting the second over-driving value that is applied to the pixels so as to over-deflect the liquid crystal layer on the basis of pre-deflection.

Finally, it should be noted that the above embodiments is only for explaining the technical solution of the present invention, and not for limitation. Although the present invention has been described in details with reference to the preferred embodiments, those skilled in the art should be appreciated that the technical solution of the present invention can be modified or equivalently replaced without departing from the spirit and scope of the technical solution of the present invention.

What is claimed is:

1. A method for compensating response time of liquid crystal display, the method comprises:

receiving gray scale data of a picture in present frame, and, for each pixel of the picture in the present frame, obtaining a first additional driving value for the pixel of the picture in the present frame by searching a first additional driving value look-up table for the gray scale data of the pixel of the picture in present frame and gray scale data of the picture in previous frame, the first additional driving value comprising a first pre-driving value and a first over-driving value;

collecting a temperature value of liquid crystal layer and obtaining a temperature driving value according to said temperature value;

generating a second additional driving value for the picture in the present frame, according to the first additional driving value and the temperature driving value, the second additional driving value comprising a second pre-driving value and a second over-driving value, wherein the second pre-driving value is generated by summing a product of the first pre-driving value and a coefficient of the first pre-driving value and a product of the temperature driving value and a coefficient of the temperature driving value, and the second over-driving value is generated by summing a product of the first over-driving value and a coefficient of the first over-driving value and a product of the temperature driving value and a coefficient of the temperature driving value; and during display of the picture in the present frame, outputting the second pre-driving value that is applied to pixels in advance so as to pre-deflect the liquid crystal layer, and then after outputting the second pre-driving value outputting the second over-driving value that is applied to pixels in overshooting manner so as to over-deflect the liquid crystal layer on the basis of pre-deflection.

2. The method for compensating response time of liquid crystal display according to claim 1, receiving gray scale data of the picture in present frame and obtaining the first additional driving value according to the comparison result between gray scale data of the picture in present frame and gray scale data of the picture in previous frame comprises:

receiving and buffering gray scale data of the picture in present frame;

reading gray scale data of the picture in previous frame from a frame memory; and searching a first additional driving value look-up table for the first additional driving value corresponding to the gray scale data of the picture in present frame and the gray scale data of the picture in previous frame.

3. The method for compensating response time of liquid crystal display according to claim 1, collecting the temperature value of liquid crystal layer and obtaining the temperature driving value according to said temperature value comprises:

collecting and processing the temperature value of liquid crystal layer;

selecting a corresponding temperature look-up table according to said temperature value; and searching the temperature look-up table for a temperature driving value corresponding to said temperature value.

4. The method for compensating response time of liquid crystal display according to claim 1, generating the second additional driving value that is applied to pixels according to the first additional driving value and the temperature driving value comprises:

receiving the first additional driving value and the temperature driving value;

searching a second additional driving value look-up table for a second additional driving value corresponding to the first additional driving value and the temperature driving value; and outputting the second additional driving value that is applied to pixels.

* * * * *